United States Patent [19]

Izquierdo

[11] 4,445,415

[45] May 1, 1984

[54] PORTABLE CASE AND STAND FOR PEDAL CONTROLS OPERATIONALLY FIXED THEREIN FOR USE WITH A KEYBOARD TEMPORARILY MOUNTABLE THEREON

[76] Inventor: George J. Izquierdo, 409 Elise Ave., Metairie, La. 70003

[21] Appl. No.: 409,195

[22] Filed: Aug. 18, 1982

[51] Int. Cl.[3] ..... A45C 11/00; G10G 5/00

[52] U.S. Cl. ..... 84/177; 206/314

[58] Field of Search ..... 84/177, 229, 230, 352, 84/353, 425, 426; 206/314

[56] References Cited

U.S. PATENT DOCUMENTS

| | | | |
|---|---|---|---|
| 1,577,680 | 3/1926 | Bilhorn | 84/352 |
| 2,494,700 | 1/1950 | Gage | 84/174 |
| 2,974,555 | 3/1961 | Andersen | 84/1.14 |
| 3,100,415 | 8/1963 | Andersen | 84/177 |
| 3,756,114 | 9/1973 | Bontempi | 84/453 |
| 4,378,881 | 4/1983 | de Vries | 206/314 |

*Primary Examiner*—Donald A. Griffin

*Attorney, Agent, or Firm*—James B. Lake, Jr.

[57] ABSTRACT

A box with a removable top and a hingable side part for closing into a case to store and carry effects control pedals and miscellaneous gear of a keyboard stand, and opening into a stand for supporting a keyboard in playing position relative to operationally fixed and connected pedals and gear.

4 Claims, 8 Drawing Figures

PORTABLE CASE AND STAND FOR PEDAL CONTROLS OPERATIONALLY FIXED THEREIN FOR USE WITH A KEYBOARD TEMPORARILY MOUNTABLE THEREON

BACKGROUND OF THE INVENTION

The invention relates to portable keyboard musical instruments (known as "keyboards" in the trade), and more particularly to a portable case and stand for pedal controls operationally fixed therein for use with a keyboard temporarily mountable thereon.

Portable keyboard musical instruments are electronically operated and controlled to produce many varied sound effects. A number of pedal controls are required, and these have been carried loose in any convenient box with with the necessary cables for connecting them to a local source of power and to associated terminals on a keyboard. Heretofore setting up before playing, and packing up after playing took substantial amounts of time as the prior art listed below discloses.

Bontempi, U.S. Pat. No. 3,756,114 teaches a keyboard, with no pedal controls disclosed, housed in a pair of curved sides that in combination provided a carrying case for the keyboard. The case is removable and is rearrangeable to provide a stand for the keyboard.

Andersen, U.S. Pat. No. 2,974,555 teaches a portable electric piano fixed in a case open at the top and front for access to keys that are covered by a removable cover for transporting, and movable legs and a single pedal control for which the case provides no storage.

A second Andersen, U.S. Pat. No. 3,100,415 teaches a case for an electronic piano with storage space for detachable legs.

And Gage, U.S. Pat. No. 2,494,700 teaches a portable piano in a case with removable legs and pedal controls, but with no place to store them when removed.

The invention, on the other had, teaches a case not only for carrying a plurality of pedal controls and connecting cables, but for fixing the pedals in permanent operational setup for playing, and providing a stand for a keyboard when the storage case is opened. The invention saves approximately an hour in setup time and in packup time, averts errors in connecting pedal controls to a power source and keyboard terminals and in the use of connecting cables with the wrong control and terminal.

SUMMARY OF THE INVENTION

An object of the invention is to substantially reduce the setup and packup time of a portable keyboard.

Another object of the invention is to provide a fixed base for pedal controls for a portable keyboard.

Yet another object of the invention is to provide a portable carrying case for a plurality of pedal controls and connecting cables.

A further object of the invention is to provide a keyboard stand by the opening of said storage case.

DETAILED DESCRIPTION OF THE INVENTION

Figure 3:
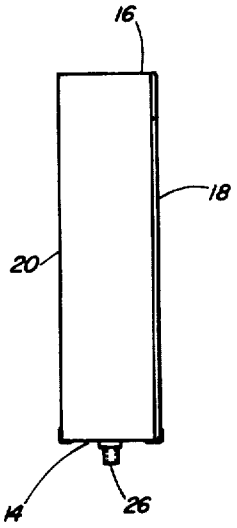
FIG. 3 is an end view of the matter of FIGS. 1 and 2.

Referring to FIGS. 1–8, the portable case and stand 10 of the invention comprises a narrow elongated box 12, having six sides, two narrow long sides 14 and 16, two narrow short sides 22 and 24, and two wide sides 18 and 20. Narrow long side 14 fits between inner surfaces of narrow short sides 22 and 24 and wide sides 18 and 20, and is held removably in place by latch bolts 28, slidably mounted adjacent oppositely disposed ends of said long narrow side 14, engaging in latch receptacles 30 fixed respectively to adjacent ends of narrow short sides 22 and 24. Right angle aluminum strips 27 are fixed to the long edges of side 14 with clearance to engage adjacent edges of wide sides 18 and 20, when side 14 is slidably engaged therebetween for holding said box 12 closed in cooperation with latch bolts 28 and receptacles 30. Carrying handles 26 are fixed to outer surface of side 14 for carrying case 10 and for removing side 14 to setup as a stand.

Wide side 18 is divided longitudinally into two parts 32 and 34. Part 32 is fixed to a long edge of narrow long side 20 and adjacent edges of narrow short sides 22 and 24, and part 34 is hinged to the free edge of part 32. The relative extents of the divided parts 32 and 34 is adapted for the free edge of part 34 when swung outwardly and upwardly orthogonal to part 32 just exceeds a desired height of a keyboard stand. A frame 36 is pivoted to part 34 adjacent the free edge thereof and adapted to swing outwardly and upwardly orthogonal to part 34. A spring catch 38, fixed to part 34, is adapted to hold frame 36 in folded position against part 34.

Frame 36 is three sided with side members orthogonally connected together at respective ends and to part 34 to define therewith a quadrilateral, two side members being parallel and vertically slotted adjacent the third orthogonally connected side member to receive the upper ends of vertically supporting legs 40, said legs 40 being stored under part 32 when not in use. The lower ends of legs 40 are retained against short narrow sides 22 and 24 by bands 41 fixed to inner surfaces of said short narrow sides. Thus the orthogonally positioned parts 32 and 34, frame 36 and legs 40 define a stand for a keyboard musical instrument, with the remaining sides of the case providing both storage and fixed playing arrangement for a plurality of effects control pedals.

Figure 8:
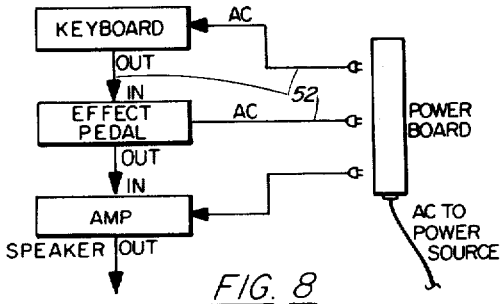
FIG. 8 is a block diagram of the cable connections.

Generally, four effects control pedals 42, 44, 46, and 48 are secured in playing position in box 12 on wide side 20. A power board 50 is also fixed on said side 20 adjacent side 22 for connection to a local a.c. electrical power supply. Connecting cables 52 connect effects control pedals and the keyboard with power board 50 as necessary for the desired effects pedals and the type of keyboard used. For example, in the use of a Rhodes portable piano, suggested effects control pedals are an electronic preamp. and wah wah 42, a mechanical sustain pedal 44, and two electronic volume pedals 46 and 48 connected as shown in FIG. 8. When a keyboard synthesizer is used some of the effects pedals require d.c. electrical power which is provided by a full wave rectifier 53 mounted on wide side 20 between power board 50 and effects pedal 42, some of which are connected to power board or rectifier and some to keyboard terminals as directed by the respective effects control pedal's instructions. Cables 52 remain attached to the effects pedals, power board and rectifier with free ends coiled under part 32 with legs 40, and a rod 54 for connecting to a sustain pedal 44 when the stand is closed into the case of the invention 10.

Figure 2:
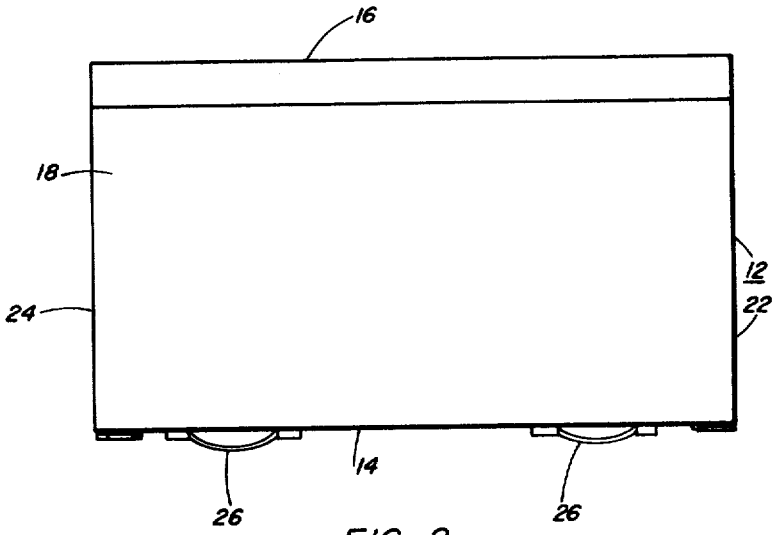
FIG. 2 is a side view of the case of FIG. 1 in opening position.
Figure 1:
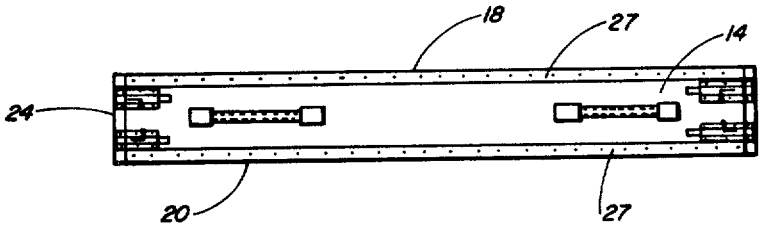
FIG. 1 is a plan view of the portable case in carrying position.
Figure 7:
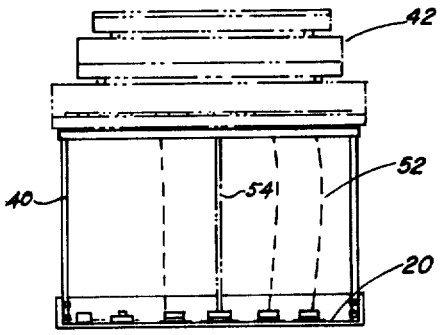
FIG. 7 is an end view of FIG. 6.
Figure 6:
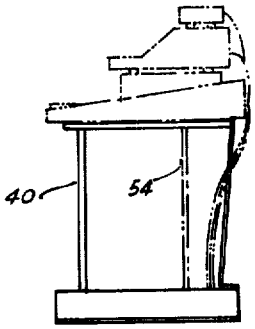
FIG. 6 is a front view of of FIG. 5 with a keyboard indicated operationally connected with pedal controls and supported on stand.
Figure 4:
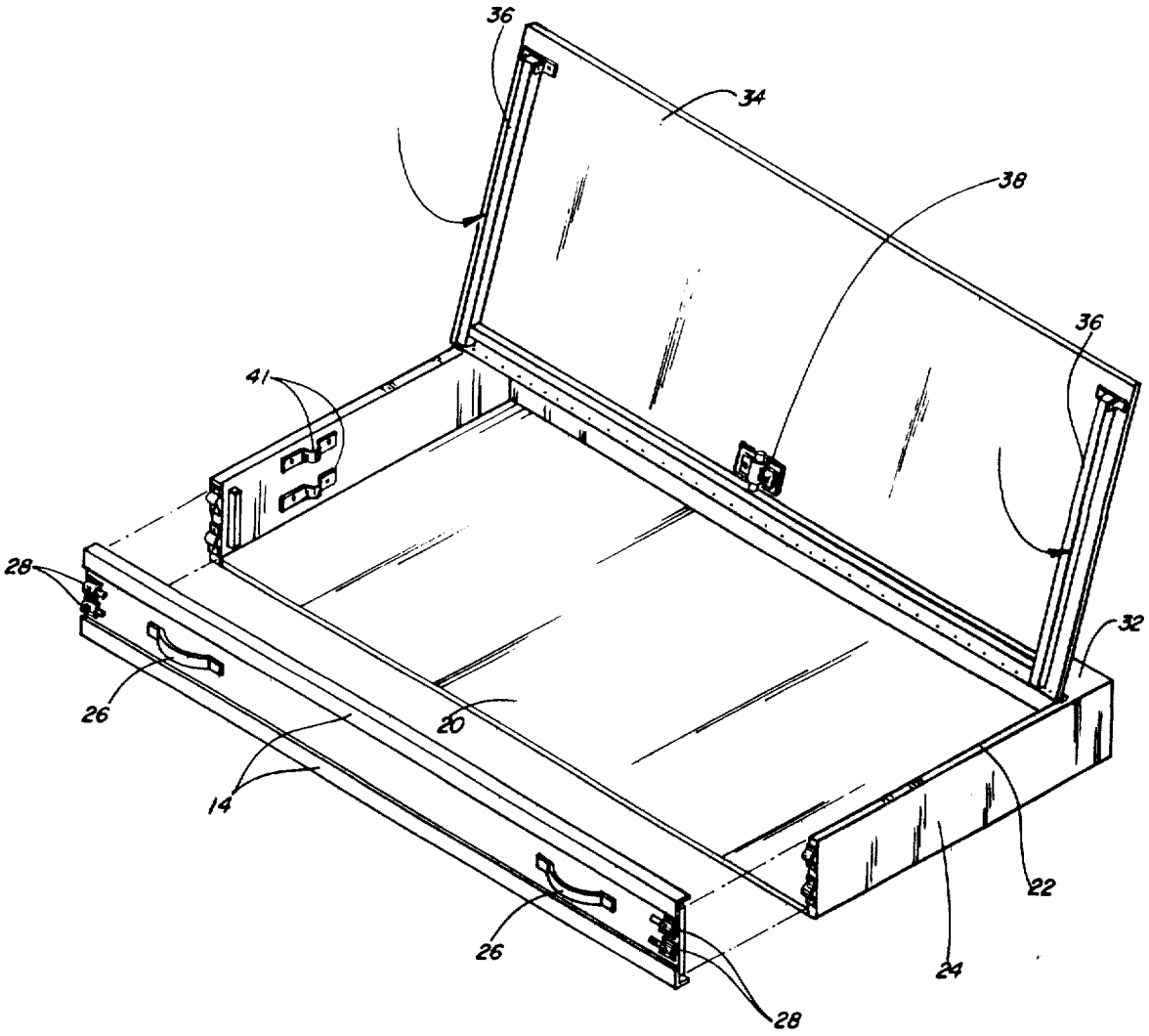
FIG. 4 is a three dimensional view of the case of FIG. 2 opened showing operationally fixed pedal controls.
Figure 5:
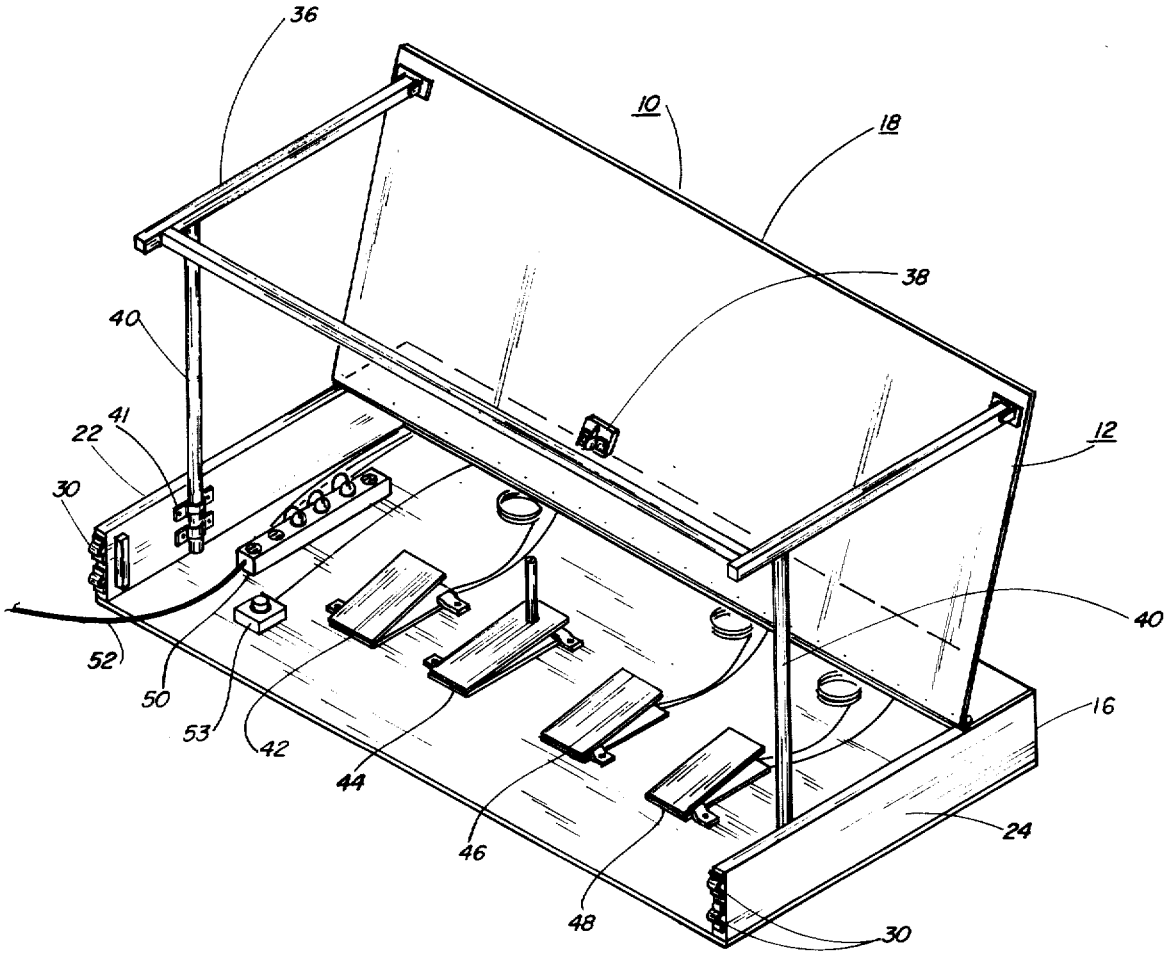
FIG. 5 is similar to FIG. 4 showing the case set up as a stand for a keyboard.

For use as a stand, box 12 is laid on wide side 20 as shown in FIGS. 2,4, and 5. Latch bolts 28 are retracted from associated receptacles 30, and long side 14 is pulled outwardly free, by handles 26, of the remainder of box 12 and placed out of the way nearby. Hinged part 34 of side 18, free of the right angles aluminum strip 27 edging side 14, is raised, opening the box and giving access to legs 40 stored under fixed part 32 of side 18. Said legs are inserted under bands 41 on each side of box 12 and adjacent its open long narrow side 14. Spring catch 38 is released and frame 36 is pivoted outwardly and upwardly as part 34 is pivoted beyond the vertical for frame 36 to clear the tops of legs 40, and then forwardly to vertical for raised frame 36 to be lowered to engage the upper ends of legs 40 in the slotted sides of frame 36, thereby providing a stand for a keyboard instrument. Connecting cables 52 connected permanently as shown in FIG. 8 by connected lines, and at each setup by arrowed lines, making energizing the keyboard and effects control pedals simple and fast. The above sequence is reversed for packing-up.

What is claimed is:

1. A portable case and stand for effects control pedals used by a keyboard temporarily mountable thereon, comprising:

(a) a narrow elongated box defines a carrying and storage compartment when closed for said pedals and miscellaneous gear, and defines a keyboard stand when opened with said pedals operationally fixed and interconnected, said box having a removable narrow elongated side and a hinged part of a wide side cooperating for said opening and closing;

(b) a frame, pivoted adjacent an oppositely disposed edge from the hinged edge of said hinged part to said wide side, is adapted to pivot upwardly and outwardly orthogonal to said hinged part that is swung outwardly orthogonal to said box; and (c) two legs, storable in said storage compartment, is adapted to vertically engage said box and frame to support said frame horizontally, with hinged part and said frame orthogonal to their respective supporting box structure, whereby a keyboard placed on said horizontally supported frame is operationally positioned above said operationally fixed and connected effects control pedals for immediate connection therewith.

2. A portable case and stand as described in claim 1 wherein a power board and an all wave rectifier is fixed in said storage compartment to energize all pedals and the keyboard simultaneously from an outside power source and in accordance with the type of electrical energy required in each case.

3. A portable case and stand as described in claim 1 wherein said wide side is relatively divided longitudinally for the box support and the orthogonally raised hinged part together to extend upwardly more than the height of a keyboard stand by the pivot connections of said frame.

4. A portable case and stand as described in claim 1 wherein said removable narrow elongated side is longitudinally edged with engaging means for engaging adjoining upper free edges of said wide side hinged part when said box is closed.

* * * * *